US008561216B2

(12) United States Patent
Burek et al.

(10) Patent No.: US 8,561,216 B2
(45) Date of Patent: Oct. 22, 2013

(54) HELMET

(75) Inventors: Roy Burek, Chester (GB); Geoffrey King, Wrexham (GB)

(73) Assignee: Charles Owen & Co. (BOW) Limited (GB)

( * ) Notice: Subject to any disclaimer, the term of this patent is extended or adjusted under 35 U.S.C. 154(b) by 1127 days.

(21) Appl. No.: 12/248,926

(22) Filed: Oct. 10, 2008

(65) Prior Publication Data

US 2009/0133183 A1 May 28, 2009

(30) Foreign Application Priority Data

Nov. 28, 2007 (GB) ..... 0723347.1

(51) Int. Cl.
*A42B 7/00* (2006.01)

(52) U.S. Cl.
USPC ..... 2/421; 2/414; 2/411

(58) Field of Classification Search
USPC ..... 2/411, 414, 415, 416, 417, 418, 420, 2/421, 422, 425
See application file for complete search history.

(56) References Cited

U.S. PATENT DOCUMENTS

| | | | | |
|---|---|---|---|---|
| 3,790,962 | A | 2/1974 | Plastino | |
| 3,852,821 | A | 12/1974 | Mickel | |
| 4,423,524 | A * | 1/1984 | Kralik et al. | 2/416 |
| 4,724,549 | A * | 2/1988 | Herder et al. | 2/411 |
| 4,947,488 | A * | 8/1990 | Ashinoff | 2/181 |
| 5,115,382 | A * | 5/1992 | Smith | 362/105 |
| 5,377,360 | A * | 1/1995 | Fleitman | 2/181 |
| 5,774,901 | A * | 7/1998 | Minami | 2/421 |
| 5,930,841 | A * | 8/1999 | Lampe et al. | 2/411 |
| 5,946,734 | A * | 9/1999 | Vogan | 2/412 |
| 6,438,761 | B1 * | 8/2002 | McGarrity | 2/410 |
| 6,446,271 | B1 * | 9/2002 | Ho | 2/414 |
| 6,625,820 | B1 * | 9/2003 | Lampe | 2/425 |
| 6,978,487 | B2 * | 12/2005 | Abraham | 2/425 |
| 2005/0193477 | A1 * | 9/2005 | Penny | 2/411 |
| 2005/0262619 | A1 | 12/2005 | Musal et al. | |
| 2007/0089219 | A1 | 4/2007 | Trainor et al. | |
| 2009/0133183 | A1 * | 5/2009 | Burek et al. | 2/414 |

FOREIGN PATENT DOCUMENTS

WO WO 03/096832 11/2003

OTHER PUBLICATIONS

Search Report UK—IPO for Corresponding GB application, published Nov. 10, 2008.

* cited by examiner

*Primary Examiner* — Khoa Huynh
*Assistant Examiner* — Andrew W Collins
(74) *Attorney, Agent, or Firm* — Fleit Gibbons Gutman Bongini & Bianco PL; Paul D. Bianco; Martin Fleit

(57) ABSTRACT

The invention provides a helmet for protecting the head of a wearer and includes a helmet body and a strap for coupling the helmet to the head, the strap being secured to the helmet body. The strap has two halves, each with a front portion for passing under the wearer's chin and a rear portion for passing around the side and rear of the wearer's head. The front portion of each strap half has an end that is secured to the helmet body at a first location at the side and the second portion has an end that is secured to the helmet body towards the rear. An elastically deformable element, such as a suction cup and/or a pad, is located in a pocket towards the end of the second portion. This provides additional grip, comfort, and security.

20 Claims, 3 Drawing Sheets

HELMET

BACKGROUND OF THE INVENTION

The present invention relates to a helmet and in particular, but not exclusively, to a horse riding helmet.

Horse riding helmets have long been employed to prevent or reduce the damage caused by impacts to the heads of horse riders. They typically comprise a hard outer shell that provides structural rigidity and resistance to physical impacts and a soft inner lining. The lining has two effects, the first is to improve the comfort for the wearer of the helmet and the second is to help reduce the force transmitted to the wearer's skull from any impacts to the outer shell by reducing the maximum deceleration on impact. The helmet is fitted with a strap that, when fastened, holds the helmet in place and prevents it from becoming dislodged. The strap is formed in two halves, each being anchored securely to the outer shell by a rivet. The two strap halves depend from the sides and can be brought together and secured to one another under the wearer's chin by means of a buckle or the like.

Each of the strap halves may be secured to the helmet at two positions, a first location to the side of the helmet and a second location at the rear. The strap not only serves to restrict the vertical movement relative to the wearer's head but also any slipping of the helmet on the wearer's head from side to side or front to rear.

It is an object of the present invention to provide an improved helmet.

SUMMARY OF THE INVENTION

In a first aspect, the present invention provides a helmet for protecting the head of a wearer comprising: a helmet body; and a strap for coupling the helmet to the head, the strap being secured to the helmet body; the strap comprising a first portion intended to pass under the chin of a wearer and a second portion joined to said first portion and intended to pass around the rear and side of a wearer's head; the first portion having an end that is secured to the helmet body at a first location and the second portion having an end that is secured to the helmet body at a second location, spaced from the first location; and a pocket in the second portion of the strap containing a resiliently deformable element.

The resiliently deformable element serves to provide additional grip and comfort for the wearer. It may take any suitable form but in one embodiment it takes the form of an elastomeric pad such as, for example, a suction cup that has a convex side and a concave side. The cup may be substantially disc-shaped and may be positioned in the pocket such that the concave side faces the wearer. When the strap is tensioned against the wearer's head the cup may deform so as to apply the gripping force to the wearer's head. A foam pad may also be inserted in the pocket on the concave side of the cup, to enhance comfort.

The pocket may be disposed near the end of the second part of the strap where it is secured to the helmet body. This provides the best fit for the wearer. The arrangement serves to improve the safety of the helmet.

The strap may comprise a first portion with an end that is secured to the helmet body at a first location and a second portion with an end that is secured to the helmet at a second location (the first and second locations being different on each strap part). The first and second portions may be integrally connected or formed.

The second location may be spaced from a rearmost portion of helmet body, it may be spaced from the rearmost position by a distance in the range 80 to 100 mm, along the edge of the helmet body, and preferably in the range 85 to 95 mm and more preferably 95 mm. The second location may be positioned such that it subtends an angle in the range 50° to 80° to a central line that intersects the rearmost and foremost locations of the helmet.

The strap may comprise two parts, possibly halves, that are designed to be fastened together in use. Each of the parts may comprise the first and second portions described above.

The second locations of each strap may be separated by a distance in the range 160 to 200 mm, more preferably 170 to 190 mm and most preferably around 180 mm.

The helmet body may comprise an outer shell and an inner lining. The first and second ends of the strap or each part of the strap may be secured to the body between the outer shell and the inner lining.

The strap or strap parts may have an inner web of relatively strong material and an outer comfort layer, the pocket being defined between the two.

BRIEF DESCRIPTION OF THE DRAWINGS

A specific embodiment of the present invention will now be described by way of example only with reference to the accompanying drawings, in which.

DESCRIPTION OF THE PREFERRED EMBODIMENTS

Figure 1:
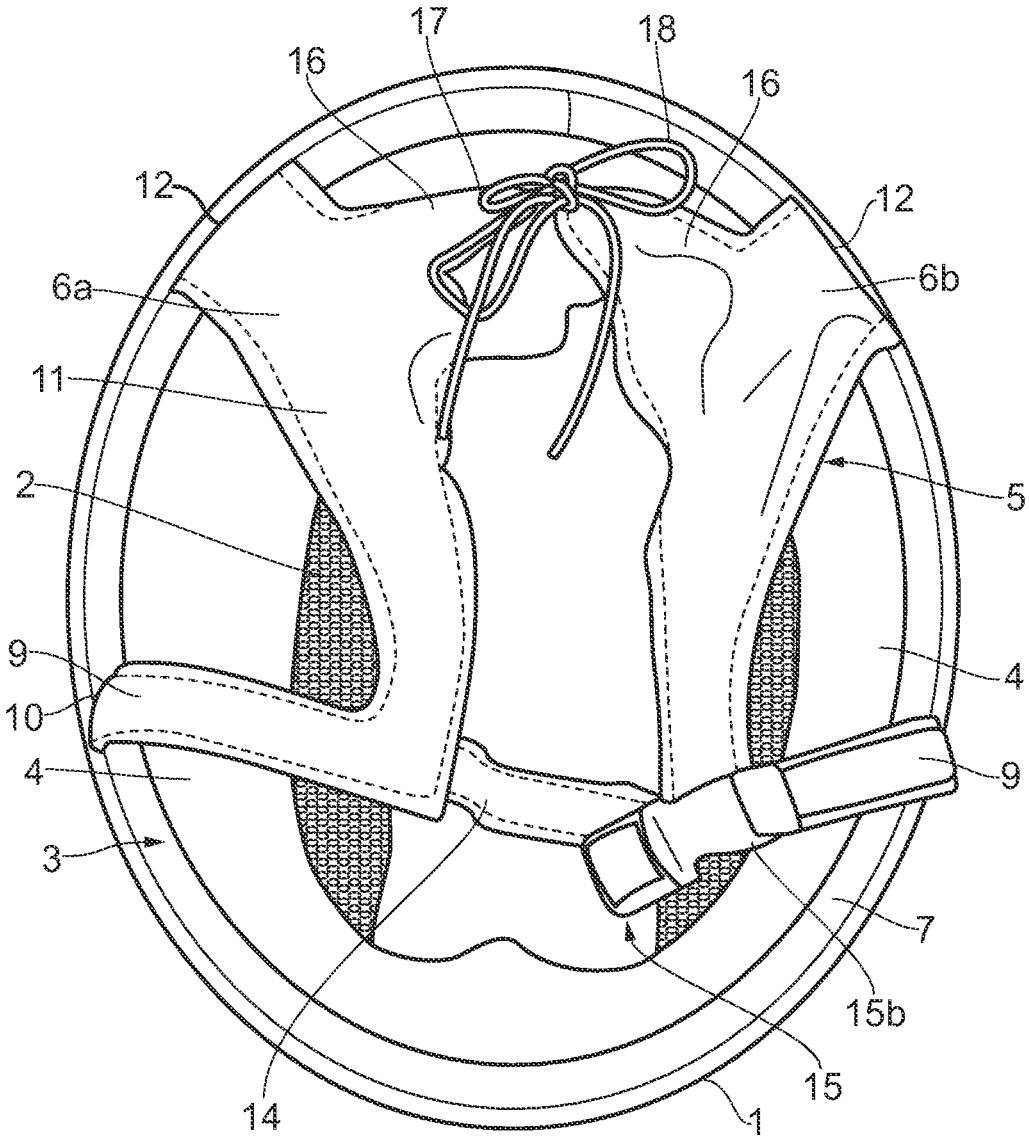
FIG. 1 is an underside view of a helmet in accordance with the present invention and showing a retaining strap.
Figure 2:
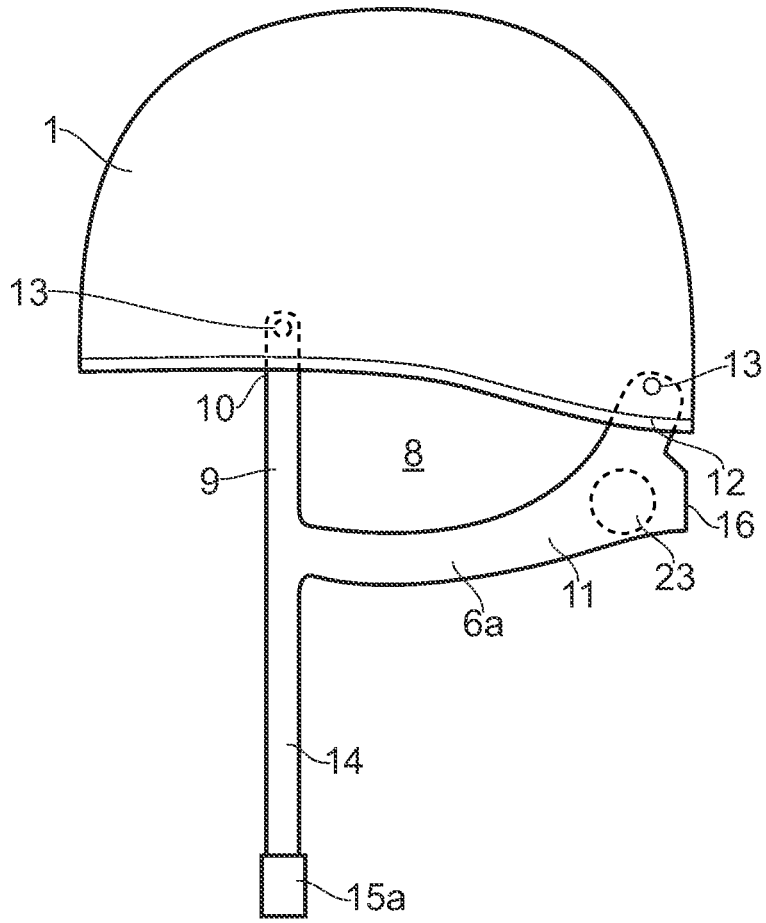
FIG. 2 is a side view of the helmet with the strap undone.

Referring now to the drawings, the helmet comprises a hard rigid bowl-shaped outer shell 1 and an inner lining 2 that sits inside the shell. The edge of the shell and the lining defines a mouth 3 that is lined by a cushioned headband 4 which is padded for wearer comfort by incorporating and/or being formed of padding material. Preferably, the headband is both soft and flexible.

In order to secure the helmet to the wearer's head there is a harness 5 that comprises two strap halves 6*a*, 6*b* each of which is fixed between the outer shell 1 and the inner lining 2 and depends therefrom such that when a user wears the helmet, the two strap halves 6*a*, 6*b* can be brought together and fastened under the chin of a wearer.

The headband 4 is attached to the shell 1 by a material hinge 7 and to portions of the lining 2 by an adhesive (not shown). The hinge 7 may be formed of any flexible material, including the material forming the headband 4, or any part thereof. The hinge 7 is mainly fixed between the lining and the shell, but in some places it is fixed between the lining and part of a strap half.

Each strap half 6*a*, 6*b* is connected to the helmet shell 1 at two spaced locations and is configured to depend downwardly from those locations on one side of the wearer's head in such a way as to form a loop 8 with the edge of the helmet shell, the loop passing around the ear of the wearer. A front part 9 of the strap half is fixed to a side portion of the helmet at a first end 10 and extends substantially downwardly from the edge of the shell 1 whereas a rear part 11 of the strap half 6*a*, 6*b*, which is integrally formed with the front part 9, extends rearwardly from the front part 9 to a second end 12 where it is fixed adjacent to the rear of the helmet. In each case the first and second ends 10, 12 of the strap half 6*a*, 6*b* are received between the outer shell 1 and the lining 2 and fixed in place by a rivet 13, although it is to be understood that other fixings may be used. The position of the second ends 12 of the strap halves are disposed such that the rivets and are separated by a distance of around 180 mm, although it is to be understood that this may be varied by around +/20 mm at least.

At the intersection of the front and rear parts 9, 11 of the strap half 6*a* on one side there is an elongate extension piece 14 to the strap that is designed to pass under the wearer's chin and which terminates in a first part 15*a* of a releasable clip fastener 15. The intersection of the strap parts 9, 11 of the on the other side simply has a complementary second part 15*b* of the clip fastener 15.

Towards the rear of the helmet, adjacent the second end 12 of each strap half 6*a*, 6*b* there is an integral, protruding tab 16 that extends from the rear part 11. The front edge of the tab has three eyelets 17 by which it may be fastened to the corresponding tab 16 on the other strap half by means of a lace 18. The corresponding tab 16 similarly has three eyelets along its front edge.

When the helmet is worn the strap halves 6*a*, 6*b* pass over the side and rear parts of the wearer's head. The extension piece 14 is passed under the chin and the two parts 15*a*, 15*b* of clip 15 fastened together and tightened so as to bring the strap halves together in a secure fit to the wearer's head.

Figure 3:
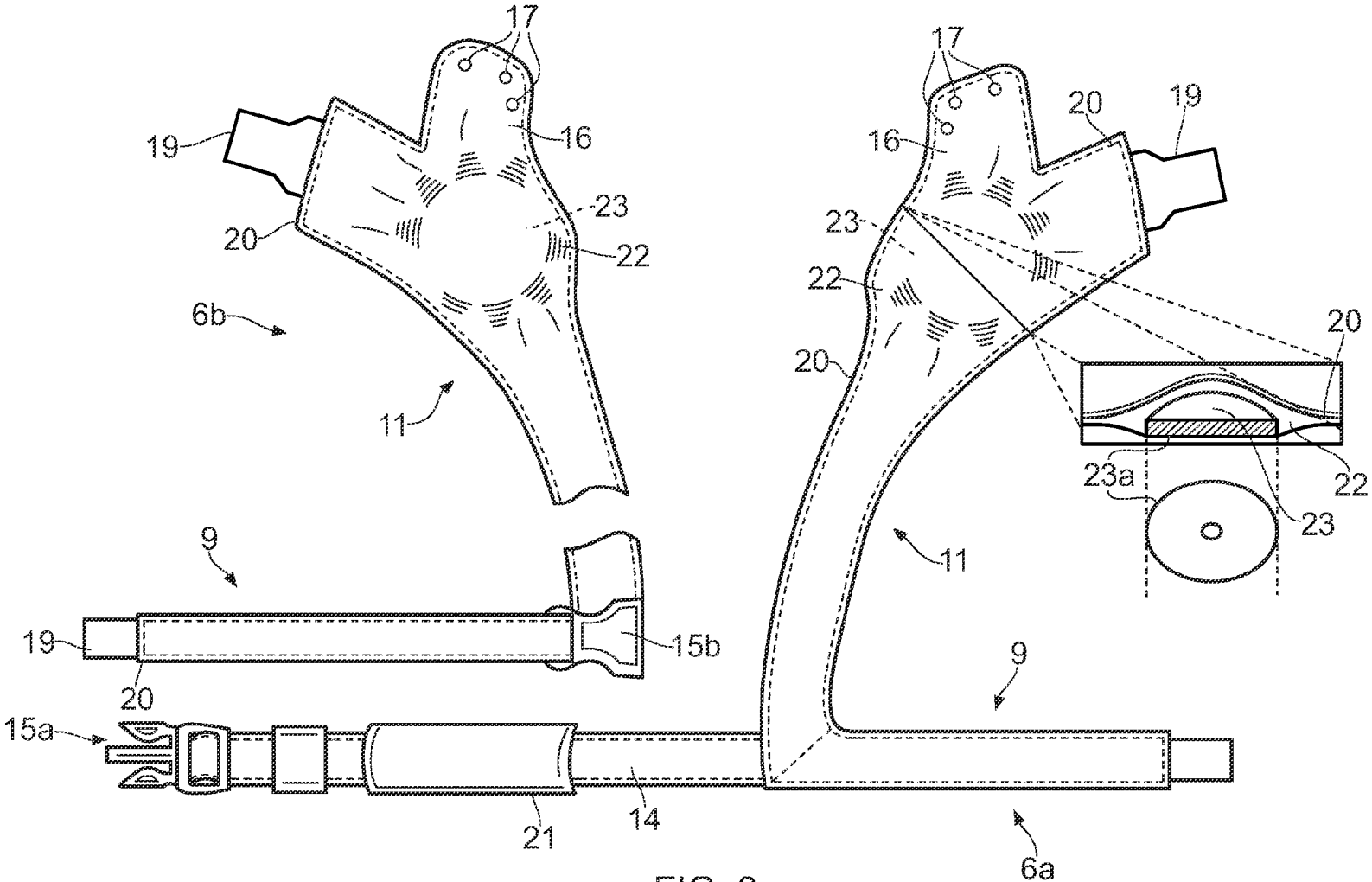
FIG. 3 illustrates only the strap of the helmet of FIGS. 1 and 2.

The strap halves 6*a*, 6*b* can take any suitable form. In the embodiment shown they comprise a strong inner web 19, which may be of reinforced woven material, that is covered by a soft leather sleeve 20 for comfort. This is depicted in FIG. 3. A chin pad 21 may be provided over the extension piece 14.

At the intersection of the second part 11 of the strap half with the tab part 16 there is a relatively wide portion of the sleeve defining a pocket 22 in which a suction cup 23 is received (see FIG. 1 and 3 and, in particular, the inset to FIG. 3). The suction cup 23 comprises a disc of elastomeric rubber or plastics material such as polyvinylchloride or the like that is dished so as to have a convex outer surface and a concave inner surface for facing the head of the wearer. The concave side of the cup bears against the side of the wearer's head and when the harness is tensioned the cup is deformed to a flatter profile such that air is expelled out of the cup. The reaction force applied by the cup allows the harness to "grip" the wearer's head slightly so that a good fit is ensured whilst providing additional comfort. In order to enhance comfort further, a circular renticulated foam pad 23*a* is inserted in the pocket 22 between the concave inner surface of the suction cup 23 and the harness. It is to be understood that any type of resiliently deformable pad or element may be used in place of the suction cup.

The second end of the strap half is fixed at a location on the helmet that is spaced further from the rearmost point of the helmet out compared to the location on a conventional helmet so that the second part of the strap half passes more around the side of the wearer's head than the rear. It will be appreciated that in the embodiment shown in the figures this spacing is about 90 mm. However, it may be in the region of 80 to 100 mm and still achieve the same effect. The combination of this position and the presence of the cup serves to generate a better combination of forces for retaining the helmet on the wearer's head without impairing comfort and ensuring that the helmet is a good fit.

It will be appreciated that the above embodiment is described for example only and that numerous modifications could be made to the design without departing from the scope of the invention as defined by the claims. For instance, whilst the harness may be in the form of a strap it will be appreciated that it may take any suitable form such as webbing, chord or the like. Moreover, the suction cup could be replaced by any shape or form of resilient material that deforms upon tensioning of the harness against the wearer's head. Furthermore, the strap need not necessarily be configured so as to have two halves but may take any suitable form, for example it may comprise one strap piece that is attached to one side of the helmet shell and which is releasably fastened to the other.

Each of the strap halves could be fixed at three or more locations.

The shell is preferably rigid, and may be covered or coated for aesthetic reasons. The shell can be made from any one or more of glass fibre, polyester resin, carbon fibre, kevlar, abs (acrylonitrile butadiene styrene), high impact styrene, high density polyethylene or other suitable thermoplastic or thermoset plastic.

The lining may be made from any impact absorbing material, including EPS (expanded polystyrene), EPE (expanded polyethylene), EPP (expanded polypropylene) or a foamed polyurethane.

The headband can be made from any one of leather, suede, faux leather, faux suede, polyester, nylon, cotton or wool. The internal webbing of the strap halves can be made from any one of cotton, nylon, polyester, polypropylene, or a mixture thereof.

What is claimed is:

1. A helmet for protecting the head of a wearer comprising:

a helmet body; and a strap for coupling the helmet to the head of the wearer, the strap including two halves secured to the helmet body;

each half of the strap including a first portion intended to pass under a chin of the wearer and a second portion joined to said first portion and intended to pass around a rear and side of the head of the wearer;

the first portion of each half of the strap having an end secured to the helmet body at a first location and the second portion of each half of the strap having an end secured to the helmet body at a second location spaced from the first location; and the second portion of each half of the strap including a pocket containing an elastomeric suction cup having an outer side facing away from the wearer and an inner side facing toward the wearer and a pad inserted between the inner side of the elastomeric suction cup and an inner lining of the strap.

2. The helmet according to claim 1, wherein the outer side of the elastomeric suction cup is convex and the inner side of the elastomeric suction cup is concave.

3. The helmet according to claim 1, wherein the second location is spaced from a rearmost portion of the helmet body.

4. The helmet according to claim 1, wherein the first portion of each half of the strap has an end and the second portion of each half of the strap has an end.

5. The helmet according to claim 4, wherein the helmet body includes an outer shell and an inner lining.

6. The helmet according to claim 5, wherein the ends of the first portion of each half of the strap and the ends of the second portion of each half of the strap are secured to the helmet body at points between the outer shell and the inner lining.

7. The helmet according to claim 4, further comprising a tab extending from the second portion of each half of the strap, the tabs fastenable together.

8. The helmet according to claim 1, wherein the second portion of each half of the strap has an inner web and an outer comfort layer, the pocket formed between the inner web and the outer comfort layer.

9. The helmet according to claim 1, wherein the pocket is adjacent to an end of the second portion that is secured to the helmet body at the second location.

10. The helmet according to claim 1, wherein the helmet body has an outer shell defining an inwardly facing surface extending to an edge of the outer shell, and an inner lining defining an outer surface facing the inwardly facing surface of the outer shell, the inner lining having an inner surface which faces the head of the wearer of the helmet.

11. A helmet comprising:

a helmet body; and a strap for coupling the helmet to the head of a wearer, the strap including two halves secured to the helmet body;

each half of the strap including a first portion intended to pass under a chin of the wearer and a second portion joined to said first portion and intended to pass around a rear and side of the head of the wearer;

the first portion of each half of the strap having an end secured to the helmet body at a first location and the second portion of each half of the strap having an end secured to the helmet body at a second location spaced from the first location;

the second portion of each half of the strap secured to the helmet body at a location that is about 80 to 100 mm from a rearmost portion of the helmet; and the second portion of each half of the strap having a pocket containing an elastomeric suction cup and a pad.

12. The helmet according to claim 11, wherein the second portion of each half of the strap is secured to the helmet body at a location that is about 90 mm from the rearmost portion of the helmet.

13. The helmet according to claim 11, wherein the first portion of each half of the strap has an end and the second portion of each half of the strap has an end, the second portion of each half of the strap secured at points that are separated by a distance in a range of 160 to 200 mm.

14. The helmet according to claim 13, wherein the distance is about 180 mm.

15. A helmet for protecting a head of a wearer, the helmet comprising:

a helmet body having an outer shell and an inner lining inside the outer shell; and a harness for coupling the helmet to the head of the wearer, the harness including a strap composed of two halves secured to the helmet body;

each half of the strap including a first portion intended to pass under a chin of the wearer and a second portion joined to said first portion and intended to pass around a rear and side of the head of the wearer;

the first portion of each half of the strap having an end secured to the helmet body at a first location and the second portion of each half of the strap having an end secured to the helmet body at a second location spaced from the first location; and the second portion of each half of the strap having a pocket containing an elastomeric suction cup having an outer side facing away from the wearer and an inner side facing toward the wearer and a pad inserted between the inner side of the elastomeric suction cup and an inner lining of the strap, wherein the pocket is configured and arranged such that when the harness is tensioned the elastomeric suction cup and pad deform to fit the head of the wearer.

16. The helmet according to claim 1, wherein the pocket is configured and arranged such that when the strap is tensioned the elastomeric suction cup and pad deform to fit the head of the wearer.

17. The helmet according to claim 11, wherein the elastomeric suction cup has a convex outer side facing away from the wearer and a concave inner side facing toward the wearer and the pad is inserted between the concave inner side of the elastomeric suction cup and an inner lining of the strap, and wherein the pocket is configured and arranged such that when the strap is tensioned the elastomeric suction cup and the pad deform to fit the head of the wearer.

18. The helmet according to claim 1, wherein the elastomeric suction cup and the pad are completely enclosed within the pocket.

19. The helmet according to claim 11, wherein the elastomeric suction cup and the pad are completely enclosed within the pocket.

20. The helmet according to claim 15, wherein the elastomeric suction cup and the pad are completely enclosed within the pocket.

* * * * *